United States Patent [19]

Vinci

[11] Patent Number: 4,659,488

[45] **Date of Patent: * Apr. 21, 1987**

[54] METAL WORKING USING LUBRICANTS CONTAINING BASIC ALKALINE EARTH METAL SALTS

[75] Inventor: James N. Vinci, Mayfield Hts., Ohio

[73] Assignee: The Lubrizol Corporation, Wickliffe, Ohio

[ * ] Notice: The portion of the term of this patent subsequent to Mar. 19, 2002 has been disclaimed.

[21] Appl. No.: 777,475

[22] Filed: Sep. 18, 1985

[51] Int. Cl.[4] ..... C10M 135/04

[52] U.S. Cl. ..... 252/33; 252/33.4; 252/39; 252/56 R; 252/58; 252/49.6; 252/49.8; 72/42

[58] Field of Search ..... 252/33, 33.4, 39, 56 R, 252/49.6, 58, 49.8; 72/42

[56] References Cited

U.S. PATENT DOCUMENTS

| | | | |
|---|---|---|---|
| 3,776,847 | 12/1973 | Pearson | 252/33.4 |
| 3,813,337 | 5/1974 | Sheldahl | 252/33.4 |
| 4,119,549 | 4/1981 | Davis | 252/45 |

*Primary Examiner*—Jacqueline V. Howard

*Attorney, Agent, or Firm*—Denis A. Polyn; Forrest L. Collins; Karl Bozicevic

[57] ABSTRACT

Lubricants useful in metal working processes, especially cutting, comprise (A) a lubricating oil and (B) a basic alkaline earth metal salt or borated complex thereof. Component B is preferably a basic calcium sulfonate prepared by a specific method. The lubricants may also contain at least one of (C) a specific active sulfur-containing compound and (D) a chlorinated wax.

46 Claims, No Drawings

METAL WORKING USING LUBRICANTS CONTAINING BASIC ALKALINE EARTH METAL SALTS

This invention relates to metal working operations and more particularly to lubricants for use during such operations. In its broadest sense, it comprises a method for lubricating metal during working thereof and metal workpieces having on the surface thereof a film of a lubricant composition. Said composition comprises (A) a major amount of a lubricating oil and (B) a minor amount of a basic alkaline earth metal salt of at least one acidic organic compound, or a borated complex of said basic alkaline earth metal salt.

Metal working operations, for example, rolling, forging, hot-pressing, blanking, bending, stamping, drawing, cutting, punching, spinning and the like, generally employ a lubricant to facilitate the same. Lubricants greatly improve these operations in that they can reduce the power required for the operation, prevent sticking and decrease wear of dies, cutting tools and the like. In addition, they frequently provide rust inhibiting properties to the metal being treated.

Many presently known metal working lubricants are oil-based lubricants containing a relatively large amount of active sulfur present in additives therein. (By "active sulfur" as used herein is meant chemically combined sulfur in a form which causes staining of copper.) The presence of active sulfur is sometimes detrimental because of its tendency to stain copper, as well as other metals including brass and aluminum. Nevertheless, its presence has frequently been necessary because of the beneficial extreme pressure properties of active sulfur-containing compositions, especially for the working of ferrous metals.

A principal object of the present invention is to provide a method of working metal using a lubricant which is adaptable to all types of metal.

A further object is to provide a metal working method employing a lubricant which contains no active sulfur, or only a relatively small amount thereof.

Another object is to provide a metal working method employing a lubricant which is adaptable for use on a wide variety of metals including ferrous and non-ferrous metals, and also including metals which are easily stained by active sulfur-containing compositions.

Still another object is to facilitate the coating of metal workpieces with lubricants affording the above-summarized properties.

Other objects will in part be obvious and will in part appear hereinafter.

U.S. Pat. No. 4,505,830 describes lubricants useful in metal working processes which comprise a lubricating oil and a basic alkali (e.g., sodium, potassium, lithium) metal salt or borated complex thereof. I have discovered, surprisingly, that basic alkaline earth (e.g., calcium, magnesium, barium, strontium) metal salts or borated complexes thereof can be used in metal working processes, and unlike the alkali metal salts, they do not exhibit severe foaming problems. I have also discovered, surprisingly, that the alkaline earth metal salts of this invention have superior demulsibility, greater compatibility with esters (e.g., less gellation) and less water sensitivity than the alkali metal salts described in U.S. Pat. No. 4,505,830.

As will be apparent from the above summary of the invention, it involves the use as metal working lubricants of compositions in which the major constituent is a lubricating oil. Suitable lubricating oils include natural and synthetic oils and mixtures thereof.

Natural oils are often preferred; they include liquid petroleum oils and solvent-treated or acid-treated mineral lubricating oils of the paraffinic, naphthenic and mixed paraffinic-naphtenic types. Oils of lubricating viscosity derived from coal or shale are also useful base oils.

Synthetic lubricating oils include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes)]; alkylbenzenes [e.g., dodecylbenzenes, tetradecylbenzenes, dinonylbenzenes, di(2-ethylhexyl)benzenes]; polyphenyls (e.g., biphenyls, terphenyls, alkylated polyphenyls); and alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof, for example, the acetic acid esters, mixed C3–C8 fatty acid esters and C13 Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids) with a variety of alcohols (e.g., butyle alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisoctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethyl-hexanoic acid.

Esters useful as synthetic oils also include those made from C5 to C12 monocarboxylic acids and polyols and polyol ethers such as neopentyl glycol, trimethylolpropane, pentraerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetra-(p-tert-butylphenyl)silicate, hexa-(4-methyl-2-pentoxy)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used as component A according to the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more purification steps to improved one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Component B is preferably a basic alkaline earth metal salt of at least one acidic organic compound. This component is among those art-recognized metal-containing compositions variously referred to by such names as "basic", "superbased" and "overbased" salts or complexes. The method for their preparation is commonly referred to as "overbasing". The term "metal ratio" is often used to define the quantity of metal in these salts or complexes relative to the quantity or organic anion, and is defined as the ratio of the number of equivalents of metal to the number of equivalents thereof which would be present in a normal salt based upon the usual stoichiometry of the compounds involved.

The alkaline earth metals present in the basic alkaline earth metal salts include principally calcium, magnesium, barium and strontium, with calcium being preferred because of its availability and relatively low cost. The most useful acidic organic compounds are carboxylic acids, sulfonic acids, organic phosphorus acids and phenols.

The sulfonic acids are preferred for use in the preparation of component B. They include those represented by the formulas $R^1(SO_3H)_r$ and $(R^2)_xT(SO_3H)_y$. In these formulas, $R^1$ is an aliphatic or aliphatic-substituted cycloaliphatic hydrocarbon or essentially hydrocarbon radical free from acetylenic unsaturation and containing up to about 60 carbon atoms. When $R^1$ is aliphatic, it usually contains at least about 15 carbon atoms; when it is an aliphatic-substituted cycloaliphatic radical, the aliphatic substituents usually contain a total of at least about 12 carbon atoms. Examples of $R^1$ are alkyl, alkenyl and alkoxyalkyl radicals, and aliphatic-substituted cycloaliphatic radicals wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of $R^1$ are cetylcyclohexyl, laurylcyclohexyl, cetyloxyethyl, octadecenyl, and radicals derived from petroleum, saturated and unsaturated paraffin wax, and olefin polymers including polymerized monoolefins and diolefins containing about 2–8 carbon atoms per olefinic monomer unit. $R^1$ can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O—or —S—, as long as the essentially hydrocarbon character thereof is not destroyed.

$R^2$ is generally a hydrocarbon or essentially hydrocarbon radical free from acetylenic unsaturation and containing from about 4 to about 60 aliphatic carbon atoms, preferably an aliphatic hydrocarbon radical such as alkyl or alkenyl. It may also, however, contain substituents or interrupting groups such as those enumerated above provided the essentially hydrocarbon character thereof is retained. In general, any non-carbon atoms present in $R^1$ or $R^2$ do not account for more than 10% of the total weight thereof.

The radical T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1–3. The subscripts r and y have an average value of about 1–4 per molecule and are generally also 1.

Illustrative sulfonic acids useful in the preparation of component B are mahogany sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl Beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax sulfonic acids, nitroso-substituted paraffin wax sulfonic acids, petroleum naphthene-sulfonic acids, cetylcyclopentyl sulfonic acids, lauryl cyclohexyl sulfonic acids, mono- and polywax-substituted cyclohexyl sulfonic acids, postdodecylbenzene sulfonic acids, "dimer alkylate" sulfonic acids, and the like. These sulfonic acids are well-known in the art and require no further discussion herein.

Suitable carboxylic acids include aliphatic, cycloaliphatic and aromatic mono- and polybasic carboxylic acids free from acetylenic unsaturation, including naphthenic acids, alkyl- or alkenyl-substituted cyclopentanoic acids, alkyl- or alkenyl-substituted cyclohexanoic acids, and alkyl- or alkenyl-substituted aromatic carboxylic acids. The aliphatic acids generally contain from about 8 to about 50, and preferably from about 12 to about 25, carbon atoms. The cycloaliphatic and aliphatic carboxylic acids are preferred, and they can be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, lauric acid, oleic acid, ricinoleic acid, undecyclic acid, dioctylcyclopentanecarboxylic acid, myristic acid, dilauryldecahydronaphthalene-carboxylic acid, stearyloctahydroindenecarboxylic acid, palmitic acid, alkyl- and alkenylsuccinic acids, acids formed by oxidation of petrolatum or of hydrocarbon waxes, and commercially available mixtures of two or more carboxylic acids, such as tall oil acids, rosin acids, and the like.

The pentavalent phosphorus acids useful in the preparation of component B may be represented by the formula

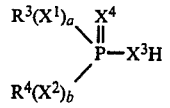

wherein each of $R^3$ and $R^4$ is hydrogen or a hydrocarbon or essentially hydrocarbon radical preferably having from about 4 to about 25 carbon atoms, at least one of $R^3$ and $R^4$ being hydrocarbon or essentially hydrocarbon; each of $X^1$, $X^2$, $X^3$ and $X^4$ is oxygen or sulfur; and each of a and b is 0 or 1. Thus, it will be appreciated that the phosphorus acid may be an organophosphoric, phosphonic or phosphinic acid, or a thio analog of any of these.

Usually, the phosphorus acids are those of the formula

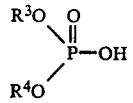

wherein $R^3$ is a phenyl radical or (preferably) an alkyl radical having up to 18 carbon atoms, and $R^4$ is hydrogen or a similar phenyl or alkyl radical. Mixtures of such phosphorus acids are often preferred because of their ease of preparation.

Component B may also be prepared from phenols; that is, compounds containing a hydroxy radical bound directly to an aromatic ring. The term "phenol" as used herein includes compounds having more than one hydroxy group bound to an aromatic ring, such as catechol, resorcinol and hydroquinone. It also includes alkylphenols such as the cresols and ethylphenols, and alkenylphenols. Preferred are phenols containing at least one alkyl substituent containing about 3–100 and especially about 6–50 carbon atoms, such as heptylphenol, octylphenol, dodecylphenol, tetrapropenealkylated phenol, octadecylphenol and polybutenylphenols. Phenols containing more than one alkyl substituent may also be used, but the monoalkylphenols are preferred because of their availability and ease of production.

Also useful are condensation products of the above-described phenols with at least one lower aldehyde, the term "lower" denoting aldehydes containing not more than 7 carbon atoms. Suitable aldehydes include formaldehyde, acetaldehyde, propionaldehyde, the butyraldehydes, the valeraldehydes and benzaldehyde. Also suitable are aldehyde-yielding reagents such as paraformaldehyde, trioxane, methylol, Methyl Formcel and paraldehyde. Formaldehyde and the formaldehyde-yielding reagents are especially preferred.

The equivalent weight of the acidic organic compound is its molecular weight divided by the number of acidic groups (i.e., sulfonic acid, carboxy or acidic hydroxy groups) present per molecule.

Especially preferred for use as component B are basic alkaline earth metal salts having metal ratios from about 4 to about 40, preferably from about 6 to about 30 and especially from about 8 to about 25, and prepared by intimately contacting for a period of time sufficient to form a stable dispersion, at a temperature between the solidification temperature of the reaction mixture and its decomposition temperature:

(B-1) at least one acidic gaseous material selected from the group consisting of carbon dioxide, hydrogen sulfide and sulfur dioxide, with (B-2) a reaction mixture comprising (B-2-a) at least one oil-soluble sulfonic acid, or derivative thereof susceptible to overbasing;

(B-2-b) at least one alkaline earth metal or basic alkeline earth metal compound;

(B-2-c) at least one lower aliphatic alcohol; and (B-2-d) at least one oil-soluble carboxylic acid or functional derivative thereof.

Reagent B-1 is at least one acidic gaseous material which may be carbon dioxide, hydrogen sulfide or sulfur dioxide; mixtures of these gases are also useful. Carbon dioxide is preferred because of its relatively low cost, availability, ease of use and performance.

Reagent B-2 is a mixture containing at least four components of which component B-2-a is at least one oil-soluble sulfonic acid as previously defined, or a derivative thereof susceptible to overbasing. Mixtures of sulfonic acids and/or their derivatives may also be used. Sulfonic acid derivatives susceptible to overbasing include their metal salts, especially the alkaline earth, zinc and lead salts; ammonium salts and amine salts (e.g., the ethylamine, butylamine and ethylene polyamine salts); and esters such as butylamine and ethylene polyamine salts); and esters such as the ethyl, butyl and glycerol esters.

Component B-2-b is at least one alkaline earth metal or a basic compound thereof. Illustrative of basic alkaline earth metal compounds are the hydroxides, alkoxides (typically those in which the alkoxy group contains up to 10 and preferably up to 7 carbon atoms), hydrides and amides. Thus, useful basic alkaline earth metal compounds include calcium hydroxide, magnesium hydroxide, barium hydroxide, stratium hydroxide, calcium oxide, magnesium oxide, barium oxide, strontium oxide, calcium hydride, magnesium hydride, barium hydride, stratium hydride, calcium ethoxide, calcium butoxide and calcium amide. Especially preferred are calcium oxide and calcium hydroxide and the calcium lower alkoxides (i.e., those containing up to 7 carbon atoms). The equivalent weight of component B-2-b for the purpose of this invention is equal to twice its molecular weight, since the alkaline earth metals are divalent.

Component B-2-c is at least one lower aliphatic alcohol, preferably a monohydric or dihydric alcohol. Illustrative alcohols are methanol, ethanol, 1-propanol, 1-hexanol, isopropanol, isobutanol, 2-pentanol, 2,2-dimethyl-1-propanol, ethylene glycol, 1-3-propanediol and 1,5-pentanediol. Of these, the preferred alcohols are methanol, ethanol and propanol, with methanol being especially preferred. The equivalent weight of component B-2-c is its molecular weight divided by the number of hydroxy groups per molecule.

Component B-2-d is at least one oil-soluble carboxylic acid as previously described, or functional derivative thereof. Especially suitable carboxylic acids are those of the formula $R^5(COOH)_n$, wherein n is an integer from 1 to 6 and is preferably 1 or 2 and $R^5$ is a saturated or substantially saturated aliphatic radical (preferably a hydrocarbon radical) having at least 8 aliphatic carbon atoms. Depending upon the value of n, $R^5$ will be a monovalent to hexavalent radical.

$R^5$ may contain non-hydrocarbon substituents provided they do not alter substantially its hydrocarbon character. Such substituents are preferably present in amounts of not more than about 10% by weight. Exemplary substituents include the non-hydrocarbon substituents enumerated hereinabove with reference to component B-2-a. $R^5$ may also contain olefinic unsaturation up to a maximum of about 5% and preferably not more than 2% olefinic linkages based upon the total number of carbon-to-carbon covalent linkages present. The number of carbon atoms in $R^5$ is usually about 8–700 depending upon the source of $R^5$. As discussed below, a preferred series of carboxylic acids and derivatives is prepared by reacting an olefin polymer or halogenated olefin polymer with an alpha, beta-unsaturated acid or its anhydride such as acrylic, methacrylic, maleic or fumaric acid or maleic anhydride to form the corresponding substituted acid or derivative thereof. The $R^5$ groups in these products have a number average molecular weight from about 150 to about 10,000 and usually from about 700 to about 5000, as determined, for example, by gel permeation chromatography.

The monocarboxylic acids useful as component B-2-d have the formula $R^5COOH$. Examples of such acids are caprylic, capric, palmitic, stearic, isostearic, linoleic and behenic acids. A particularly preferred group of monocarboxylic acids is prepared by the reaction of a halogenated olefin polymer, such as a chlorinated polybutene, with acrylic acid or methacrylic acid.

Suitable dicarboxylic acids include the substituted succinic acids having the formula $$\begin{array}{l} R^6CHCOOH \\ \quad\;\; | \\ \quad\;\; CH_2COOH \end{array}$$

wherein $R^6$ is the same as $R^5$ as defined above. $R^6$ may be an olefin polymer-derived group formed by polymerization of such monomers as ethylene, propylene, 1-butene, isobutene, 1-pentene, 2-pentene, 1-hexene and 3-hexene. $R^6$ may also be derived from a high molecular weight substantially saturated petroleum fraction. The hydrocarbon-substituted succinic acids and their derivatives constitute the most preferred class of The above-described classes of carboxylic acids derived from olefin polymers, and their derivatives, are well known in the art, and methods for their preparation as well as representative examples of the types useful in the present invention are described in detail in a number of U.S. patents.

Functional derivatives of the above-discussed acids useful as component B-2-d includes the anhydrides, esters, amides, imides, amidines and metal salts. The reaction products of olefin polymer-substituted succinic acids and mono- or polyamines, particularly polyalkylene polyamines, having up to about ten amino nitrogens are especially suitable. These reaction products generally comprise mixtures of one or more of amides, imides and amidines. The reaction products of polyethylene amines containing up to about 10 nitrogen atoms and polybutene-substituted succinic anhydride wherein the polybutene radical comprises principally isobutene units are particularly useful. Included in this group of functional derivatives are the compositions prepared by post-treating the amine-anhydride reaction product with carbon disulfide, boron compounds, nitriles, urea, thiourea, guanidine, alkylene oxides or the like. The half-amide, half-metal salt and half-ester, half-metal salt derivatives of such substituted succinic acids are also useful.

Also useful are the esters prepared by the reaction of the substituted acids or anhydrides with a mono- or polyhydroxy compound, such as an aliphatic alcohol or a phenol. Preferred are the esters of olefin polymer-substituted succinic acids or anhydrides and polyhydric aliphatic alcohols containing 2–10 hydroxy groups and up to about 40 aliphatic carbon atoms. This class of alcohols includes ethylene glycol, glycerol, sorbitol, pentaerythritol, polyethylene glycol, diethanolamine, triethanolamine, N,N-di(hydroxyethyl)ethylene diamine and the like. When the alcohol contains reactive amino groups, the reaction product may comprise products resulting from the reaction of the acid group with both the hydroxy and amino functions. Thus, this reaction mixture can include half-esters, half-amides, esters, amides, and imides.

The ratios of equivalents of the constituents of reagent B-2 may vary widely. In general, the ratio of component B-2-b to B-2-a is at least about 4:1 and usually not more than about 40:1, preferably between 61 and 30:1 and most preferably between 8:1 and 25:1. While this ratio may sometimes exceed 40:1, such an excess normally will serve no useful purpose.

The ratio of equivalents of component B-2-c to component B-2-a is between about 1:1 and 80:1, and preferably between about 2:1 and 50:1; and the ratio of equivalents of component B-2-d to component B-2-a is from about 1:1 to about 1:20 and preferably from about 1:2 to about 1:10.

Reagents B-1 and B-2 are generally contacted until there is no further reaction between the two or until the reaction substantially ceases. While it is usually preferred that the reaction be continued until no further overbased product is formed, useful dispersions can be prepared when contact between reagents B-1 and B-2 is maintained for a period of time sufficient for about 70% of reagent B-1, relative to the amount required if the reaction were permitted to proceed to its completion or "end point", to react.

The point at which the reaction is completed or substantially ceases may be ascertained by any of a number of conventional methods. One such method is measurement of the amount of gas (reagent B-1) entering and leaving the mixture; the reaction may be considered substantially complete when the amount leaving is about 90–100% of the amount entering. These amounts are readily determined by the use of metered inlet and outlet valves.

The reaction temperature is not critical. Generally, it will be between the solidification temperature of the reaction mixture and its decomposition temperature (i.e., the lowest decomposition temperature of any component thereof). Usually, the temperature will be from about 25° to about 200° C. and preferably from about 150° C. Reagents B-1 and B-2 are conveniently contacted at the reflux temperature of the mixture. This temperature will obviously depend upon the boiling points of the various components; thus, when methanol is used as component B-2-c, the contact temperature will be about the reflux temperature of methanol.

The reaction is ordinarily conducted at atmospheric pressure, although superatmospheric pressure often expedites the reaction and promotes optimum utilization of reagent B-1. The process can also be carried out at reduced pressure but, for obvious practical reasons, this is rarely done.

The reaction is usually conducted in the presence of a substantially inert, normally liquid organic diluent, which functions as both the dispersing and reaction medium. This diluent will comprise at least about 10% of the total weight of the reaction mixture. Ordinarily it will not exceed about 80% by weight, and it is preferably about 30–70% thereof.

Although a wide variety of diluents are useful, it is preferred to use a diluent which is soluble in lubricating oil. The diluent usually itself comprises a lower viscosity lubricating oil.

Other organic diluents can be employed either along or in combination with lubricating oil. Preferred diluents for this purpose include the aromatic hydrocarbons such as bezene, toluene and xylene; halogenated derivatives thereof such as chlorobenzene; lower boiling petroleum distillates such as petroleum ether and the various naphthas; normally liquid aliphatic and cycloaliphatic hydrocarbons such as hexane, heptane, hexene, cyclohexene, cyclopentane, cyclohexane and ethylcyclohexane, and their halogenated derivatives. Dialkyl ketones such as dipropyl ketone and ethyl butyl ketone, and the alkyl aryl ketones such as acetophenone, are likewise useful, as are ethers such as n-propyl ether, n-butyl ether, n-butyl methyl ether and isoamyl ether.

When a combination of oil and other diluent is used, the weight ratio of oil to the other diluent is generally from about 1:20 to about 20:1. It is usually desirable for a mineral lubricating oil to comprise at least about 50% by weight of the diluent, especially if the product is to be used as a lubricant additive. The total amount of diluent present is not particularly critical since it is inactive. However, the diluent will ordinarily comprise about 10–80% and preferably about 30–70% by weight of the reaction mixture.

The reaction is preferably conducted in the absence of water, although small amounts may be present (e.g., because of the use of technical grade reagents). Water may be present in amounts up to about 10% by weight of the reaction mixture without having harmful effects.

Upon completion of the reaction, any solids in the mixture are preferably removed by filtration or other conventional means. Optionally, readily removable diluents, the alcoholic promoters, and water formed during the reaction can be removed by conventional techniques such as distillation. It is usually desirable to remove substantially all water from the reaction mixture since the presence of water may lead to difficulties in filtration and to the formation of undesirable emulsions in fuels and lubricants. Any such water present is readily removed by heating at atmospheric or reduced pressure or by azeotropic distillation.

The chemical structure of component B is not known with certainty. The basic salts or complexes may be solutions or, more likely, stable dispersions. Alternatively, they may be regarded as "polymeric salts" formed by the reaction of the acidic material, the oil-soluble acid being overbased, and the metal compound. In view of the above, these compositions are most conveniently defined by reference to the method by which they are formed.

U.S. Pat. No. 3,377,283 is incorporated by reference herein for its disclosure of compositions suitable for use as component B and methods for their preparation. Two such useful compositions are illustrated by the following examples.

EXAMPLE 1

A calcium mahogany sulfonate is prepared by double decomposition of a 60% oil solution of 750 parts of sodium mahogany sulfonate with the solution of 750 parts of sodium mahogany sulfonate with the solution of 67 parts of calcium chloride and 63 parts of water. The reaction mass is heated for 4 hours at 90°–100° C. to effect the conversion of the sodium mahogany sulfonate to calcium mahogany sulfonate. Then, 54 parts of the 91% calcium hydroxide solution is added and the material is heated to 150° C. over a period of five hours. When the material has cooled to 40° C., 98 parts of methanol is added and 152 parts of carbon dioxide is introduced over a period of 2 hours at 42°–43° C. Water and alcohol are then removed by heating the mass to 150° C. The residue in the reaction vessel is diluted with 100 parts of mineral oil. The filtered oil solution and the desired carbonated calcium sulfonate overbased material shows the following analysis: sulfate ash content, 16.4%; a neutralization number, as measured against phenopthalein of 0.6(acidic); and a metal ratio of 2.5.

EXAMPLE 2

A mixture comprising 2890 parts of the overbased material of Example 1 (2.79 equivalents based on sulfonic acid anion), 217 parts of the calcium phenate prepared as indicated below (0.25 equivalents), 939 parts of mineral oil, 494 parts methanol, 201 parts isobutyl alcohol, 128 parts of mixed isomeric primary amyl alcohols (containing about 65% normal amyl, 3% isoamyl and 32% 2-methyl-1-butyl alcohols), 4.7 parts calcium chloride dissolved in 5.8 parts water, and 428 parts of 91% calcium hydroxide (10.6 equivalents) is stirred vigorously at 40° C. and 146 parts of carbon dioxide is introduced over a period of 1.2 hours at 40°–55° C. Thereafter, five additional portions of calcium hydroxide amounting to 173 parts each are added and each such addition is followed by the introduction of carbon dioxide as previously illustrated. After the sixth calcium hydroxide addition and the carbonation step is completed, the reaction mass is carbonated for an additional one hour at 40°–55° C. to reduce the neutralization number of the mass to 55 (basic). The carbonated reaction mixture is then heated to 150° C. under a nitrogen atmosphere to remove alcohol and any by-product water. 908 parts of oil are added and the contents of the reaction vessel is then filtered. The filtrate, an oil solution of the desired carbonated calcium sulfonate overbased material of high metal ratio shows the following analysis: sulfate ash content 52.7; neutralization number 50.9 (basic); total base number 420 (basic); and a metal ratio of 20.25.

The calcium phenate used above is prepared by adding 2550 parts of mineral oil, 960 parts (5 moles) of heptyl phenol, and 50 parts of water into a reaction vessel and stirring at 25° C. The mixture is heated to 40° C. and 7 parts of calcium hydroxide and 231 parts (7 moles) of 91% commercial paraformaldehyde is added over a period of one hour. The contents are heated to 80° C. and 200 additional parts of calcium hydroxide (making a total of 207 parts or 5 moles) is added over a period of one hour at 80°–90° C. The contents are heated to 150° C. and maintained at that temperature for 12 hours while nitrogen is blown through the mixture to assist in the removal of water. If foaming is encountered, a few drops of polymerized dimethylsilicone foam inhibitor may be added to control the foaming. The reaction mass is then filtered. The filtrate, a 33.6% oil solution of the desired calcium phenate of heptyl phenol-formaldehyde condensation product is found to contain 7.56% sulfate ash. Borated complexes of this type may be prepared by heating the basic alkaline earth metal salt with boric acid at about 50°-100° C., the number of equivalents of boric acid being roughly equal to half the number of equivalents of alkaline earth metal in the salt. U.S. Pat. No. 3,929,650 is incorporated by reference herein for its disclosure of borated complexes.

As previously mentioned, one of the advantages of the metal working lubricants used according to the present invention is frequently that they contain no active sulfur and thus may be used on a wide variety of metals, including those which are stained by active sulfur compounds. However, it is sometimes advantageous, especially when the metal working lubricant relatively small amounts of certain compositions containing active sulfur, specifically (C) at least one sulfurization product of an aliphatic, arylaliphatic or alicyclic olefinic hydrocarbon containing from about 3 to about 30 carbon atoms.

The olefinic hydrocarbons which may be sulfurized to form component C are diverse in nature. They contain at least one olefinic double bond, which is defined as a non-aromatic double bond; that is, one connecting two aliphatic carbon atoms. In its broadest sense, the olefinic hydrocarbon may be defined by the formula $R^7R^8C—CR^9R^{10}$, wherein each of $R^7$, $R^8$, $R^9$ and $R^{10}$ is hydrogen or a hydrocarbon (especially alkyl or alkenyl) radical. Any two of $R^7$, $R^8$, $R^9$ and $R^{10}$ may also together form an alkylene or substituted alkylene group; i.e., the olefinic compound may be alicyclic.

Monoolefinic and diolefinic compounds, particularly the former, are preferred in the preparation of component C, and especially terminal monoolefinic hydrocarbons; that is, those compounds in which $R^9$ and $R^{10}$ are hydrogen and $R^7$ and $R^8$ are alkyl (that is, the olefin is aliphatic). Olefinic compounds having about 3-30 and especially about 3-20 carbon atoms are particularly desirable.

Propylene, isobutene and their dimers, trimers and tetramers, and mixtures thereof are especially preferred olefinic compounds. Of these compounds, isobutene and diisobutene are particularly desirable because of their availability and the particularly high sulfur-containing compositions which can be prepared therefrom.

The sulfurizing reagent used from the preparation of component C may be, for example, sulfur, a sulfur halide such as sulfur monochloride or sulfur dichloride, a mixture of hydrogen sulfide and sulfur dioxide, or the like. Sulfur-hydrogen sulfide mixtures are often preferred and are frequently referred to hereinafter; however, it will be understood that other sulfurization agents may, when appropriate, by substituted therefor.

The amounts of sulfur and hydrogen sulfide per mole of olefinic compound are, respectively, usually about 0.3-3.0 gram-atoms and about 0.1-1.5 moles. The preferred ranges are about 0.5-2.0 gram-atoms and about 0.4-1.25 moles respectively, and the most desirable ranges are about 1.2-1.8 gram-atoms and about 0.4-0.8 mole respectively.

The temperature range in which the sulfurization reaction is carried out is generally about 50°-350° C. The preferred range is about 100°-200° C., with about 125°-180° C. being especially suitable. The reaction is often preferably conducted under superatmospheric pressure; this may be and usually is autogenous pressure (i.e., the pressure which naturally develops during the course of the reaction) but may also be externally applied pressure. The exact pressure developed during the reaction is dependent upon such factors as the design and operation of the system, the reaction temperature, and the vapor pressure of the reactants and products and it may vary during the course of the reaction.

It is frequently advantageous to incorporate materials useful as sulfurization catalysts in the reaction mixture. These materials may be acidic, basic or neutral, but are preferably basic materials, especially nitrogen bases including ammonia and amines, most often alkylamines. The amount of catalyst used is generally about 0.05-2.0% of the weight of the olefinic compound. In the case of the preferred ammonia and amine catalysts, about 0.0005-0.5 mole per mole of olefin is preferred, and about 0.001-0.1 mole is especially desirable.

Following the preparation of the sulfurized mixture, it is preferred to remove substantially all low boiling materials, typically by venting the reaction vessel or by distillation at atmospheric pressure, vacuum distillation or stripping, or passage of an inert gas such as nitrogen through the mixture at a suitable temperature and pressure.

A further optional step in the preparation of component C is the treatment of the sulfurized product, obtained as described hereinabove, to reduce active sulfur. An illustrative method is treatment with an alkali metal sulfide. Other optional treatments may be employed to remove insoluble byproducts and improve such qualities as the odor, color and staining characteristics of the sulfurized compositions.

U.S. Pat. No. 4,119,549 is incorporated by reference herein for its disclosure of suitable sulfurization products useful as component C. Several specific sulfurized compositions are described in the working examples thereof. The following examples illustrate the preparation of two such compositions.

EXAMPLE 3

Sulfur (629 parts, 19.6 moles) is charged to a jacketed high-pressure reactor which is fitted with an agitator and internal cooling coils. Refrigerated brine is circulated through the coils to cool the reactor prior to the introduction of the gaseous reactants. After sealing the reactor, evacuating to about 6 torr and cooling, 1100 parts (19.6 moles) of isobutene, 334 parts (9.8 moles) of hydrogen sulfide and 7 parts of n-butylamine are charged to the reactor. The reactor is heated, using steam in the external jacket, to a temperature of about 171° C. over about 1.5 hours. A maximum pressure of 720 psig. is reached at about 138° C. during this heat-up. Prior to reaching the peak reaction temperature, the pressure starts to decrease and continues to decrease steadily as the gaseous reactants are consumed. After about 4.75 hours at about 171° C., the unreacted hydrogen sulfide and isobutene are vented to a recovery system. After the pressure in the reactor has decreased to atmospheric, the sulfurized product is recovered as a liquid.

EXAMPLE 4

Following substantially the procedure of Example 3, 773 parts of diisobutene is reacted with 428.6 parts of sulfur and 143.6 parts of hydrogen sulfide in the presence of 2.6 parts of n-butylamine, under autogenous pressure at a temperature of about 150°-155° C. Volatile materials are removed and the sulfurized product is recovered as a liquid.

Another ingredient which is often preferably included in the metal working lubricants contemplated for use in this invention (especially for stainless steel) is (D) at least one chlorinated wax, especially a chlorinated paraffin wax. The chlorinated wax preferably has a molecular weight between about 350 and about 700 and contains about 30% to about 70% chlorine by weight.

Other additives which may optionally be present in the metal working lubricants for use in this invention include:

Antioxidants, typically hindered phenols.

Surfactants, usually non-ionic surfactants such as oxyalkylated phenols and the like.

Corrosion, wear and rust inhibiting agents.

Friction modifying agents, of which the following are illustrative: alkyl or alkenyl phosphates or phosphites in which the alkyl or alkenyl group contains from about 10 to about 40 carbon atoms, and metal salts thereof, especially zinc salts; $C_{10-20}$ fatty acid amides; $C_{10-20}$ alkyl amines, especially tallow amines and ethoxylated derivatives thereof; salts of such amines with acids such as boric acid or phosphoric acid which have been partially esterified as noted above; $C_{10-20}$ alkyl-substituted imidazolines and similar nitrogen heterocycles.

The metal working lubricants whose use is contemplated according to this invention will generally contain from about 0.5% to about 50% by weight, preferably from about 1% to about 80%, of component B. If either or both of component C and component D are used, they will be present in amounts within the same ranges. Most often, the amount of component C (and/or of component D, if present) will be approximately equal to that of component B.

The comparative examples shown in the following tables are formulated (Table 1) and evaluated in side by side tests (Table 2–4) for the purpose of study.

TABLE 1

| Ingredient | COMPARATIVE EXAMPLES A | B | C | D | E | F | G | H | I | J | K | L | M | N | O |
|---|---|---|---|---|---|---|---|---|---|---|---|---|---|---|---|
| Mineral Oil | 90.45 | 90.45 | 91.10 | 91.10 | 90.00 | 91.10 | 90.45 | 90.90 | 90.40 | 90.90 | 90.40 | 92.20 | 91.70 | 92.20 | 91.70 |
| Example 1 of U.S. Pat. No. 4,505,830 | 2.05 | 2.05 | | | | | 2.05 | 4.10 | 4.10 | 4.10 | 4.10 | | | | |
| Product of Example 2 | | | 1.40 | 1.40 | | 1.40 | | | | | | 2.80 | 2.80 | 2.80 | 2.80 |
| Product of Example 4 | 2.50 | 2.50 | 2.50 | 2.50 | 2.50 | 2.50 | 2.50 | | | | | | | | |
| Lard Oil | 5.00 | 5.00 | 5.00 | 5.00 | | | | 5.00 | 5.00 | | | 5.00 | 5.00 | | |
| Sulfurized fatty ester fatty acid olefin mixture | | | | | 5.00 | 5.00 | 5.00 | | | 5.00 | 5.00 | | | 5.00 | 5.00 |
| Demulsifier from Tretolite | | 50 ppm | | 50 ppm | | | | | | | | | | | |
| Chlorinated Paraffin (40% Cl) | | | | | 2.50 | | | | | | | | | | |
| Water | | | | | | | | | .50 | | .50 | | .50 | | .50 |

*parts by weight

TABLE 2

WHEELING STEEL DEMULSIBILITY TEST
ASTM D-1401 @ 54.5° C.

| Example | A | B | C | D |
|---|---|---|---|---|
| Time | 30 | 30 | 30 | 30 |
| Water (ml) | 0 | 22 | 0 | 30 |
| Oil (ml) | 0 | 15 | 0 | 40 |
| Emulsion (ml) | 80 | 43 | 80 | 0 |

TABLE 3

FOAM TESTS
ASTM D-892

| Tendency/ Stability (ml) | Example E | F | G |
|---|---|---|---|
| Seq. I | 150–0 | 170–0 | 360–310 |

TABLE 3-continued

FOAM TESTS
ASTM D-892

| Tendency/ Stability (ml) | Example E | F | G |
|---|---|---|---|
| Seq. II | 20–0 | 20–0 | 330–10 |
| Seq. III | 100–0 | 110–0 | 600–570 |

Table 4 demonstrates the greater compatibility of alkaline earth sulfonates over alkali earth sulfonates. This study measures and compares viscosities initially and after a one week storage period. An increase in viscosity of 5% or greater is taken as a sign of reaction (saponification). Storage experiments are conducted with and without the addition of 0.5% water. Water is a promoter of saponification. The unusual appearance of the mixture is also taken as a criterion. Precipitation or gelling is indicative of reaction.

The compatibility experiments are conducted by adding the components to a vessel and mixing to insure complete dispersion of the components. The viscosities and blend appearance are noted and the vessels stored at 65° C. for one week wherein the viscosities and blend appearance are again noted.

TABLE 4

COMPATIBILITY STUDY
VISCOSITY, cSt @ 40° C.

| Example | Initial | After One Week @ 65° C. | Blend Appearance |
|---|---|---|---|
| H | 23.80 | 22.00 | Clear |
| I | 26.50 | —* | Gel |
| J | 31.10 | 31.00 | Clear |
| K | 31.50 | —* | Gel |
| L | 22.80 | 22.80 | Clear |
| M | 22.30 | 22.90 | Clear |
| N | 26.90 | 26.90 | Clear |
| O | 26.90 | 26.30 | Clear |

*Indicates that composition was too viscous to measure.

Any metal to be worked may be treated according to the method of this invention. Examples are ferrous metals, aluminum, copper, magnesium, titanium, zinc and manganese. Alloys thereof, with an without other elements such as silicon, may also be treated; examples of suitable alloys are brass and various steels (e.g., stainless steel.

The compositions used in the method of this invention can be applied to the metal workpiece prior to or during the working operation in any suitable manner. They may be applied to the entire surface of the metal, or to any portion of that surface with which contact is desired. For example, the lubricant can be brushed or sprayed on the metal, or the metal can be immersed in a bath of the lubricant. In high speed metal forming operations spraying or immersion are preferred.

In a typical embodiment of the method of this invention, a ferrous metal workpiece is coated with the lubricant prior to the working operation. For example, if the workpiece is to be cut it may be coated with the lubricant before contact with the cutting tool. (The invention is particularly useful in connection with cutting operations.) it is also within the scope of the invention to apply the lubricant to the workpiece as it contacts the cutting tool, or to apply it to the cutting tool itself whereupon it is transferred to the workpiece by contact. Thus, the method of this invention in a generic sense comprises any metal working operation wherein the workpiece has on its surface, during said operation, the above-described lubricant regardless of how applied.

What is claimed is:

1. A method for lubricating metal during working thereof which comprises applying to said metal a water-free composition comprising (A) a major amount of a lubricating oil; (B) a minor amount of a basic alkaline earth metal salt of at least one acidic organic compound, or a borated complex of said basic alkaline earth metal salt; and (C) a minor amount of at least one sulfurization product of an aliphatic, arylaliphatic or alicyclic olefinic hydrocarbon containing from about 3 to about 30 carbon atoms, said sulfurization product containing active sulfur.

2. A method according to claim 1 wherein component C is prepared by reacting at about 50°–300° C., under superatmospheric pressure, sulfur and hydrogen sulfide with at least one olefinic compound containing 3 to about 30 carbon atoms to form a sulfurized mixture, about 0.3–3.0 gram-atoms of sulfur and about 0.1–1.5 moles of hydrogen sulfide being used per mole of olefinic compound; and removing from said sulfurized mixture substantially all low boiling materials including unreacted olefin, mercaptan and monosulfide.

3. A method according to claim 1, wherein said alkaline earth metal salt is selected from the group consisting of calcium, magnesium, barium and strontium.

4. A method according to claim 1, wherein said alkaline earth metal salt is calcium.

5. A method according to claim 2 wherein the olefinic compound is an olefinic hydrocarbon containing from 3 to about 20 carbon atoms.

6. A method according to claim 3 wherein the olefin is propene, isobutene or a dimer, trimer or tetramer thereof, or a mixture thereof.

7. A method according to claim 4 wherein the olefin is isobutene or diisobutene.

8. A method according to claim 1 wherein said composition additionally contains (D) at least one chlorinated wax.

9. A method according to claim 3 wherein said composition additionally contains (D) at least one chlorinated wax.

10. A method according to claim 5 wherein said composition additionally contains (D) at least one chlorinated wax.

11. A metal workpiece having on the surface thereof a film of a composition comprising (A) a major amount of lubricating oil; (B) a minor amount of basic alkaline earth metal salt of at least one acidic organic compound, or of a borated complex of said basic alkaline earth metal salt; and (c) at least one sulfurization product or an aliphatic, arylaliphatic or alicyclic olefinic hydrocarbon containing from about 3 to about 30 carbon atoms, said sulfurization product containing a substantial amount of active sulfur.

12. A workpiece according to claim 11 wherein component B is a salt of at least one of sulfonic, carboxylic and organic phosphorus acids and phenols.

13. A workpiece according to claim 12 wherein component B is prepared by contacting, at a temperature between the solidification temperature of the reaction mixture and its decomposition temperature:

(B-1) at least one acidic gaseous material selected from the group consisting of carbon dioxide, hydrogen sulfide and sulfur dioxide, with (B-2) a reaction mixture comprising (B-2-a) at least one oil-soluble sulfonic acid, or derivative thereof susceptible to overbasing;

(B-2-b) at least one alkaline earth metal selected from the group consisting of calcium, magnesium, barium and strontium, or a hydroxide, alkoxide, hydride or amide thereof;

(B-2-c) at least one lower aliphatic alcohol; and (B-2-d) at least one oil-soluble carboxylic acid or functional derivative thereof.

14. A workpiece according to claim 11 wherein B-1 is carbon dioxide.

15. A workpiece according to claim 14 wherein the ratios of equivalents of the components of reagent B-2 are:

(B-2-b)/(B-2-a)—at least 4:1;

(B-2-c)/(B-2-a)—between about 1:1 and about 80:1;

(B-2-d)/(B-2-a)—between about 1:1 and about 1:20.

16. A workpiece according to claim 15 wherein (B-2-d) is at least one hydrocarbon-substituted succinic acid or functional derivative thereof and the reaction temperature is in the range of about 25°–200° C.

17. A workpiece according to claim 16 wherein (B-2-a) is an acid represented by one of the formulas $R^1(SO_3H)_r$ or $(R^2)_xT(SO_3H)_y$ in which $R^1$ and $R^2$ are each independently an aliphatic radical free from acetylenic unsaturation and containing up to 60 carbon atoms, T is an aromatic hydrocarbon nucleus, x is a number from 1 to 3, and r and y are numbers from 1 to 4.

18. A workpiece according to claim 17 wherein (B-2-a) is an alkylated benzenesulfonic acid.

19. A workpiece according to claim 18 wherein (B-2-b) is calcium or a calcium compound.

20. A workpiece according to claim 19 wherein (B-2-c) is at least one of methanol, ethanol, propanol, butanol and pentanol and component (B-2-d) is at least one of polybutenyl succinic acid and polybutenyl succinic anhydride wherein the polybutenyl group comprises principally isobutene units and has a number average molecular weight between about 700 and about 10,000.

21. A workpiece according to claim 20 wherein (B-2-b) is calcium hydroxide or a calcium alkoxide and component (B-2-c) is methanol.

22. A workpiece according to claim 11 wherein C is prepared by reacting at about 50°–300° C., under superatmospheric pressure, sulfur and hydrogen sulfide with at least one olefinic compound containing 3 to about 30 carbon atoms to form a sulfurized mixture; about 0.3–3.0 gram-atoms of sulfur and about 0.1–1.5 moles of hydrogen sulfide being used per mole of olefinic compound; and removing from said sulfurized mixture substantially all low boiling materials including unreacted olefin, mercaptan and monosulfide.

23. A workpiece according to claim 22 wherein the olefinic compound is an olefinic hydrocarbon containing from 3 to about 20 carbon atoms.

24. A workpiece according to claim 23 wherein the olefin is propene, isobutene or a dimer, trimer or tetramer thereof, or a mixture thereof.

25. A workpiece according to claim 24 wherein the olefin is isobutene or diisobutene.

26. A workpiece as claimed in any of claims 14, 16, 18 or 21 wherein said composition additionally contains (D) at least one chlorinated wax.

27. A workpiece according to claim 11 wherein said composition additionally contains (D) at least one chlorinated wax.

28. A workpiece according to claim 23 wherein said composition additionally contains (D) at least one chlorinated wax.

29. A workpiece according to claim 25 wherein said composition additionally contains (D) at least one chlorinated wax.

30. A method for lubricating metal during working thereof which comprises applying to said metal a water-free composition comprising (A) a major amount of a lubricating oil; (B) a minor amount of a basic alkaline earth metal salt of at least one sulfonic carboxylic and organic phosphoric acids and phenols or a borated complex of said basic alkaline earth metal salt; and (C) a minor amount of at least one sulfurization product of an aliphatic, arylaliphatic or alicyclic olefinic hydrocarbon containing from about 3 to about 30 carbon atoms, said sulfurization product containing active sulfur.

31. A method according to claim 30 wherein component C is prepared by reacting at about 50°-300° C., under superatmospheric pressure, sulfur and hydrogen sulfide with at least one olefinic compound containing 3 to about 30 carbon atoms to form a sulfurized mixture, about 0.3-3.0 gram-atoms of sulfur and about 0.1-1.5 moles of hydrogen sulfide being used per mole of olefinic compound; and removing from said sulfurized mixture substantially all low boiling materials including unreacted olefin, mercaptan and monosulfide.

32. A method according to claim 31 wherein the olefinic compound is an olefinic hydrocarbon containing from 3 to about 20 carbon atoms.

33. A method according to claim 32 wherein the olefin is propene, isobutene or a dimer, trimer or tetramer thereof, or a mixture thereof.

34. A method according to claim 33 wherein the olefin is isobutene or diisobutene.

35. A method according to claim 30 wherein said composition additionally contains (D) at least one chlorinated wax.

36. A method according to claim 32 wherein said composition additionally contains (D) at least one chlorinated wax.

37. A method according to claim 34 wherein said composition additionally contains (D) at least one chlorinated wax.

38. A method according to claims 30, 31, 32, 33, 34, 35, 36 or 37, wherein component (B) is prepared by contacting, at a temperature between the solidification temperature of the reaction mixture and its decomposition temperature;

(B-1) at least one acidic gaseous material selected from the group consisting of carbon dioxide, hydrogen sulfide and sulfur dioxide, with (B-2) a reaction mixture comprising (B-2-a) at least one oil-soluble sulfonic acid, or derivative thereof susceptible to overbasing;

(B-2-b) at least one alkaline earth metal selected from the group consisting of calcium, magnesium, barium and stratium, or a hydroxide, alkoxide, hydride or amide thereof;

(B-2-c) at least one lower aliphatic alcohol; and (B-2-d) at least one oil-soluble carboxylic acid or functional derivative thereof.

39. A method according to claim 38 wherein reagent B-1 is carbon dioxide.

40. A method according to claim 39 wherein the ratios of equivalents of the components of reagent B-2 are:

(B-2-b)/(B-2-a)—at least 4:1;

(B-2-c)/(B-2-a)—between about 1:1 and about 80:1;

(B-2-d)/(B-2-a)—between about 1:1 and about 1:20.

41. A method according to claim 40 wherein component (B-2-d) is at least one hydrocarbon-substituted succinic acid or functional derivative thereof and the reaction temperature is in the range of about 25°-200° C.

42. A method according to claim 41 wherein component (B-2-a) is an acid represented by one of the formulas $R^1(SO_3H)$ or $(R^2)H_xT(SO_3H)_y$ in which $R^1$ and $R^2$ are each independently an aliphatic radical free from acetylenic unsaturation and containing up to 60 carbon atoms, T is an aromatic hydrocarbon nucleus, x is a number from 1 to 3 and r and y are numbers from 1 to 4.

43. A method according to claim 42 wherein component (B-2-a) is an alkylated benzenesulfonic acid.

44. A method according to claim 43 wherein component (B-2-b) is calcium or a calcium compound.

45. A method according to claim 44 wherein component (B-2-c) is at least one of methanol, ethanol, propanol, butanol and pentanol and component (B-2-d) is at least one of polybutenyl succinic acid and polybutenyl succinic anhydride wherein the polybutenyl group comprises principally isobutene units and has a number average molecular weight between about 700 and 10,000.

46. A method according to claim 45 wherein component (B-2-c) is methanol.

* * * * *